US012479551B2

(12) United States Patent
Waltrip et al.

(10) Patent No.: US 12,479,551 B2
(45) Date of Patent: Nov. 25, 2025

(54) TROLLING MOTOR FUSE

(71) Applicant: Navico, Inc., Tulsa, OK (US)

(72) Inventors: David Lance Waltrip, Tulsa, OK (US); Guy A. Coonts, Ripley, OK (US)

(73) Assignee: Navico, Inc., Tulsa, OK (US)

( * ) Notice: Subject to any disclaimer, the term of this patent is extended or adjusted under 35 U.S.C. 154(b) by 458 days.

(21) Appl. No.: 18/182,106

(22) Filed: Mar. 10, 2023

(65) Prior Publication Data

US 2024/0300632 A1 Sep. 12, 2024

(51) Int. Cl.
*B63H 20/00* (2006.01)
*B63H 20/10* (2006.01)

(52) U.S. Cl.
CPC ..... *B63H 20/007* (2013.01); *B63H 20/106* (2013.01); *B63H 2020/103* (2013.01)

(58) Field of Classification Search
CPC ..... B63H 20/007; B63H 20/106; B63H 2020/103
See application file for complete search history.

(56) References Cited

U.S. PATENT DOCUMENTS 3,995,579 A * 12/1976 Childre ..... G05D 1/0206 440/7
5,788,280 A * 8/1998 Ohsumi ..... B60R 22/023 280/805
8,801,479 B1 * 8/2014 Quail ..... B63H 20/106 440/61 R

* cited by examiner

*Primary Examiner* — Stephen P Avila
(74) *Attorney, Agent, or Firm* — Nelson Mullins Riley & Scarborough LLP

(57) ABSTRACT

Trolling motor assemblies and systems employing a fuse for protection of components thereof are provided herein. A trolling motor assembly comprises a shaft, a trolling motor housing, and a main housing. A belt extends between the trolling motor housing and the main housing. A fuse is positioned in at least one of the main housing or the trolling motor housing, and is configured to reduce stress from the shaft applying a force to the belt.

20 Claims, 13 Drawing Sheets

TROLLING MOTOR FUSE

FIELD OF THE INVENTION

Embodiments of the present invention relate generally to trolling motors, and more particularly, to systems to protect the components of the trolling motor.

BACKGROUND OF THE INVENTION

Trolling motors are often used during fishing or other marine activities. A trolling motor assembly attaches to the watercraft and is used to propel the watercraft along a body of water. While trolling motor assemblies may be utilized as the main propulsion system of watercraft, trolling motor assemblies are often utilized to provide secondary propulsion or precision maneuvering that can be ideal for fishing activities. Typically, trolling motor assemblies include a small gas or electric trolling motor for providing thrust and a steering mechanism for changing the direction of the generated thrust. Trolling motor assemblies may also include a mechanism for changing the trim of the trolling motor, either electrically or manually. Trim systems may be difficult to access for repairs and to replace components damaged by sudden and/or extreme forces.

BRIEF SUMMARY OF THE INVENTION

Electronic trim systems are configured to move the trolling motor vertically with respect to the surface of the body of water. Trim systems may utilize components spanning between the trolling motor housing and the main housing. For example, the trim system may utilize a belt extending along the shaft between the trolling motor housing and the main housing to trim the trolling motor assembly. In this regard, trim systems enable adjustment of the position of the trolling motor housing relative to the watercraft, such as enabling adjustment of the vertical position of the trolling motor housing relative to the watercraft when the trolling motor is in a deployed state.

For a trim system that utilizes a belt to effectively move the trolling motor assembly, the belt must be within a desired tension range to allow the belt to function properly. However, if the belt is over tensioned the belt may rupture (e.g., break) or slip through the connections in the main housing and/or the trolling motor housing. Accordingly, some embodiments of the present invention provide a failure point (e.g., a fuse) configured to release the tension within the belt. The failure point may be positioned within one or both of the main housing or the trolling motor housing, and is configured to fail under an application of force. In the case of a fuse, the fuse is easily accessible, and replaceable with minimal tooling, and thus, may be able to be replaced while the trolling motor is on the watercraft.

In an example embodiment, a trolling motor assembly configured for attachment to a watercraft is provided. The trolling motor assembly comprises a shaft having a first end and a second end defining a shaft axis extending therebetween; a trolling motor at least partially contained within a trolling motor housing, wherein the trolling motor housing is attached to the second end of the shaft; a main housing connected to the shaft proximate the first end of the shaft; a belt extending between the trolling motor housing and the main housing; and a fuse positioned in at least one of the main housing or the trolling motor housing, configured to reduce stress from the shaft applying a force to the belt in the at least one of the main housing or the trolling motor housing.

In some embodiments, the fuse is designed to fail under the application of a predetermined amount of the force. In some embodiments, the predetermined amount of the force is between 10-20 Newtons. In some embodiments, the force is applied along the shaft axis.

In some embodiments, the trolling motor assembly further comprises an attachment module disposed about the shaft, wherein the attachment module is configured to engage the belt to trim the shaft along the shaft axis.

In some embodiments, the fuse is made from a brittle plastic.

In some embodiments, the fuse is configured as a rupture disc.

In some embodiments, the trolling motor assembly further comprises a replacement fuse within one of either the main housing or the trolling motor housing.

In some embodiments, the belt comprises semi-elastic properties.

In some embodiments, the fuse is a spring configured to compress to alleviate tension within the belt.

In some embodiments, the fuse is positioned in the main housing.

In some embodiments, the fuse is positioned in the trolling motor housing.

In some embodiments, the trolling motor assembly further comprises an anchor positioned within the at least one of the main housing or the trolling motor housing, wherein the anchor defines a first channel extending between a first opening and a second opening, and a second channel extending between a third opening and a fourth opening, wherein the first channel is configured to receive and retain the belt; and a fastener movable within the second channel, wherein the fastener is configured to receive a tensioning screw, and wherein the tensioning screw comprises a head and a body. The fuse is positioned about the tensioning screw between the head and the anchor, wherein the fuse is designed to fail under a predetermined amount of the force that is applied to the fuse through the belt. In some embodiments, the trolling motor assembly further comprises an anchor shock absorber positioned between the fuse and the head of the tensioning screw.

In some embodiments, the trolling motor assembly further comprises a roller disposed in either the main housing or the trolling motor housing, wherein the belt is positioned over the roller; and a roller shock absorber, wherein the roller shock absorber is configured to reduce stress from the shaft applying a force to the belt in the at least one of the main housing or the trolling motor housing.

In another example embodiment, a tensioning system for use within a main housing or a trolling motor housing of a trolling motor assembly is provided. The tensioning system comprises an anchor defining a first channel extending between a first opening and a second opening, and a second channel extending between a third opening and a fourth opening, wherein the first channel is configured to receive and retain a belt of the trolling motor assembly. The tensioning system further includes a fastener movable within the second channel, wherein the fastener is configured to receive a tensioning screw, wherein the tensioning screw comprises a head and a body. The tensioning system further includes a fuse positioned about the tensioning screw between the head and the anchor, wherein the fuse is designed to fail under a predetermined amount of force applied to the fuse through the belt.

In some embodiments, the fuse defines an outer fuse diameter and an inner fuse diameter, and the tensioning screw defines a body diameter and a head diameter, wherein the head diameter is greater than the body diameter. The inner fuse diameter is greater than the body diameter, and smaller than the head diameter.

In some embodiments, the anchor is configured to move linearly with respect to the first channel and the second channel, and wherein the movement of the anchor adjusts tension in the belt.

In yet another example embodiment, a trolling motor assembly configured for attachment to a watercraft is provided. The trolling motor assembly comprises a shaft having a first end and a second end defining a shaft axis extending therebetween; a trolling motor at least partially contained within a trolling motor housing, wherein the trolling motor housing is attached to the second end of the shaft; a main housing connected to the shaft proximate the first end of the shaft; a belt extending between the trolling motor housing and the main housing; and a tensioning system disposed within at least one of the main housing or the trolling motor housing. The tensioning system comprises an anchor defining a first channel extending between a first opening and a second opening, and a second channel extending between a third opening and a fourth opening, wherein the first channel is configured to receive and retain the belt; a fastener movable within the second channel, wherein the fastener is configured to receive a tensioning screw, wherein the tensioning screw comprises a head and a body; and a fuse positioned about the tensioning screw between the head and the anchor, wherein the fuse is designed to fail under a predetermined amount of force applied to the fuse through the belt.

In some embodiments, the tensioning system is positioned in the main housing.

BRIEF DESCRIPTION OF THE DRAWINGS

Figure 1:
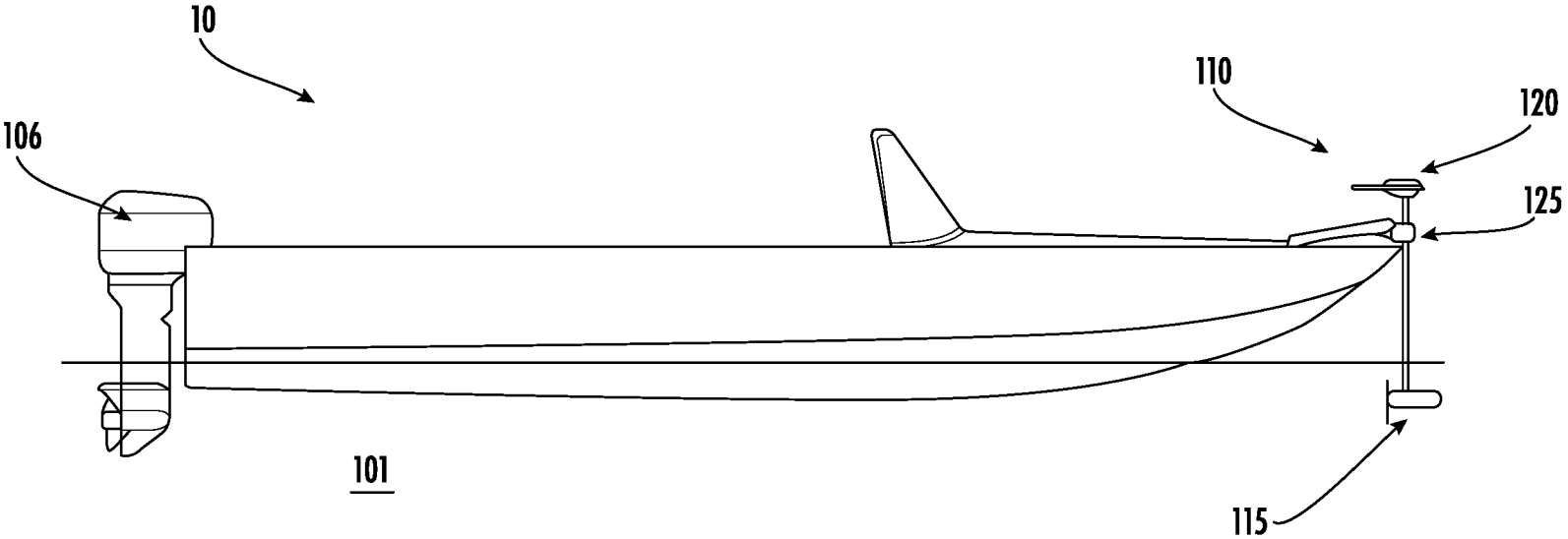
Figure 2:
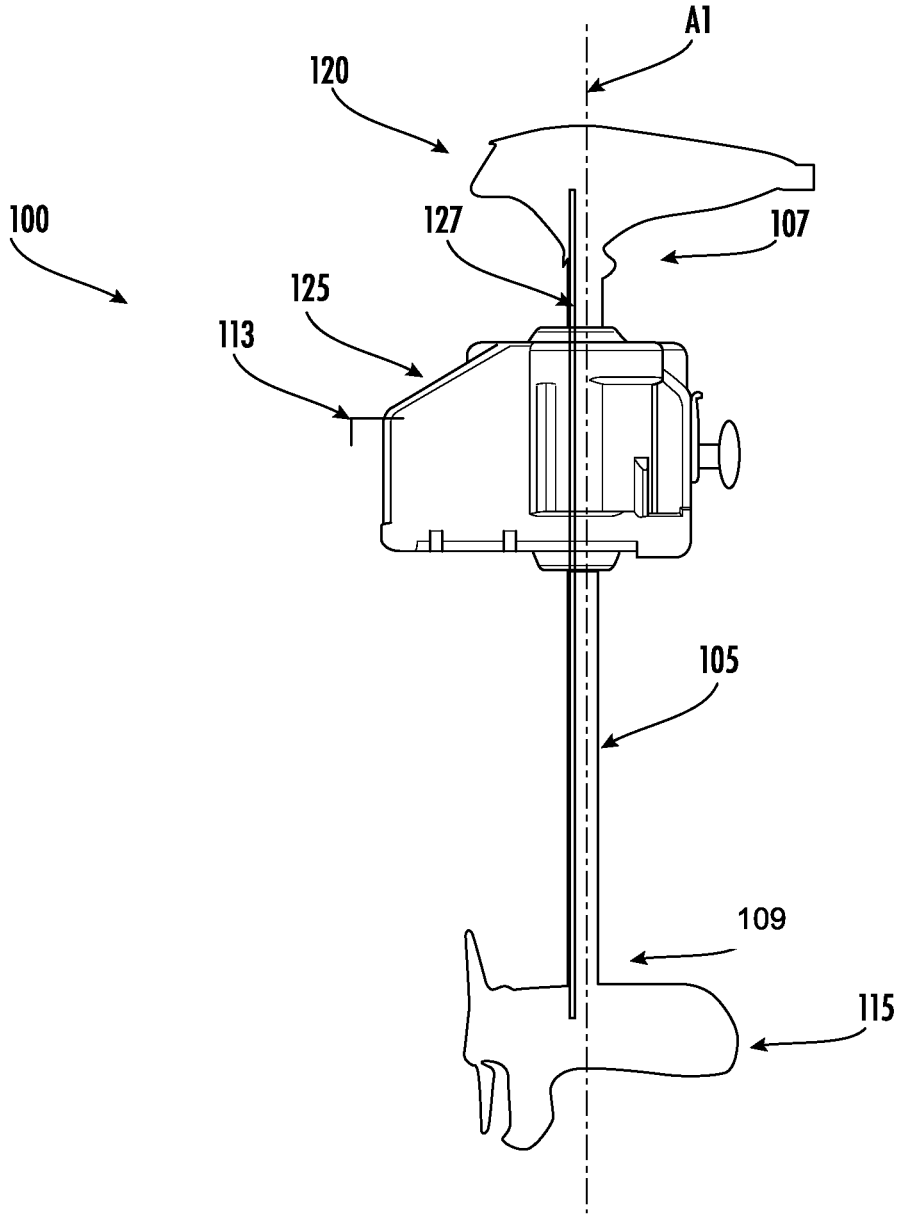
Figure 3A:
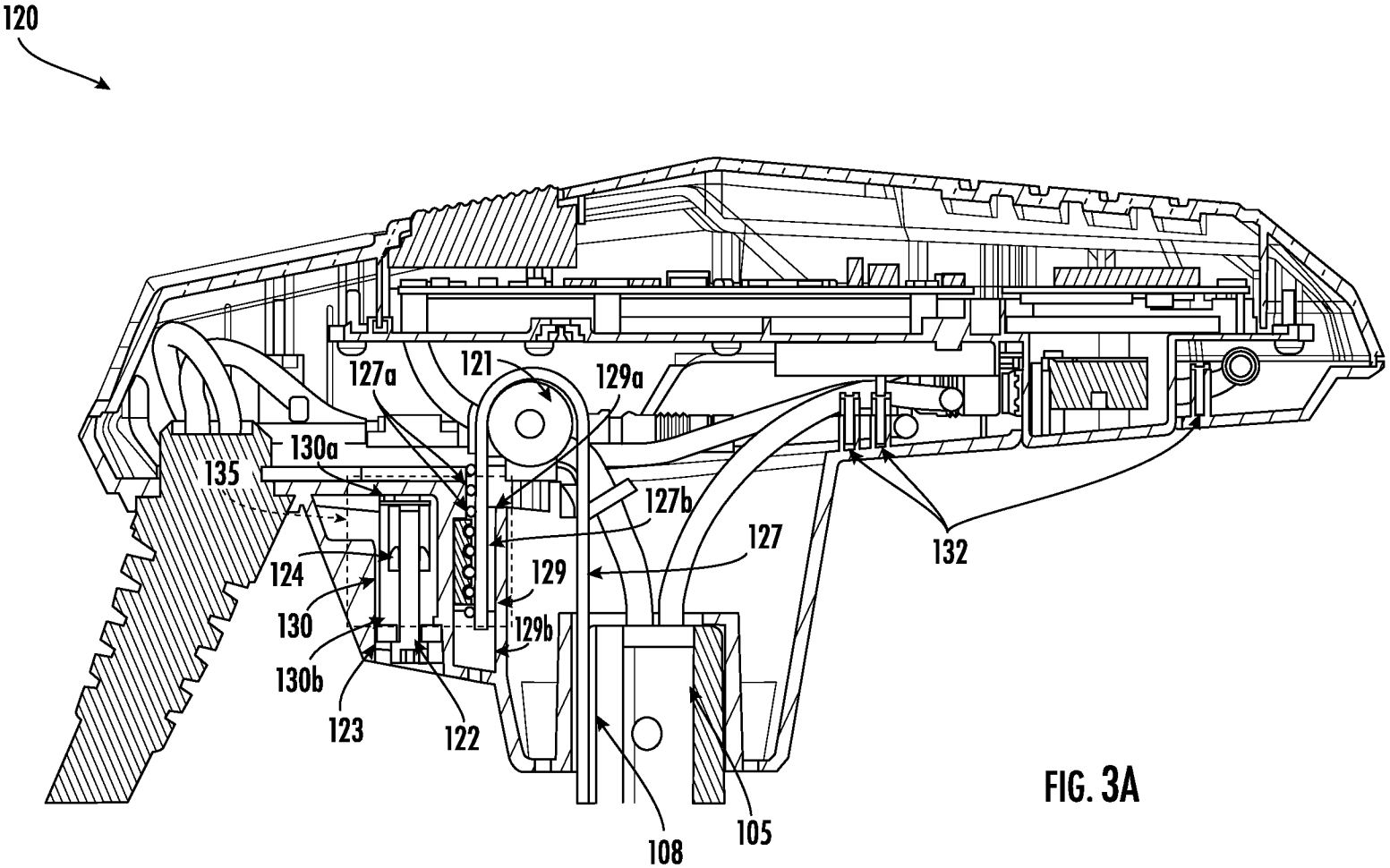
Figure 3B:
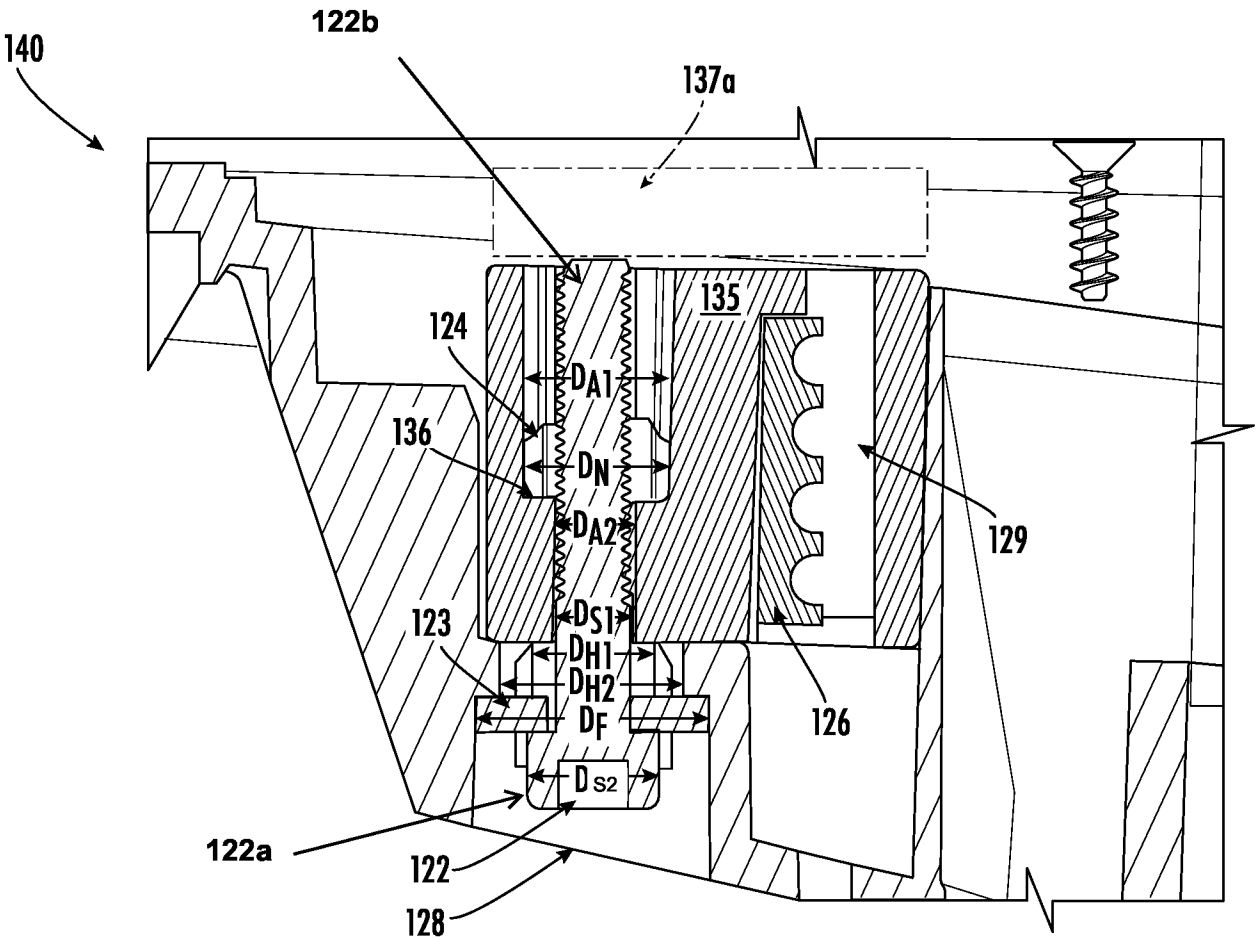
Figure 3C:
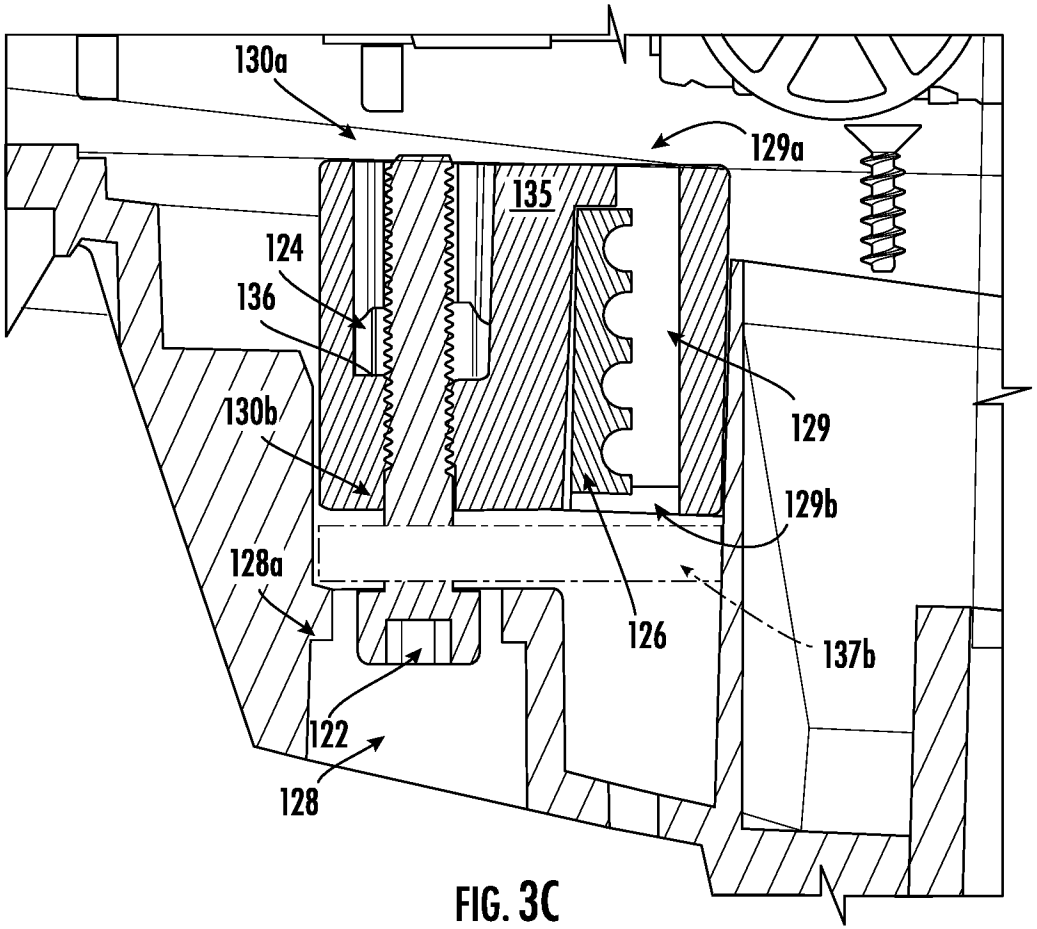
Figure 3D:
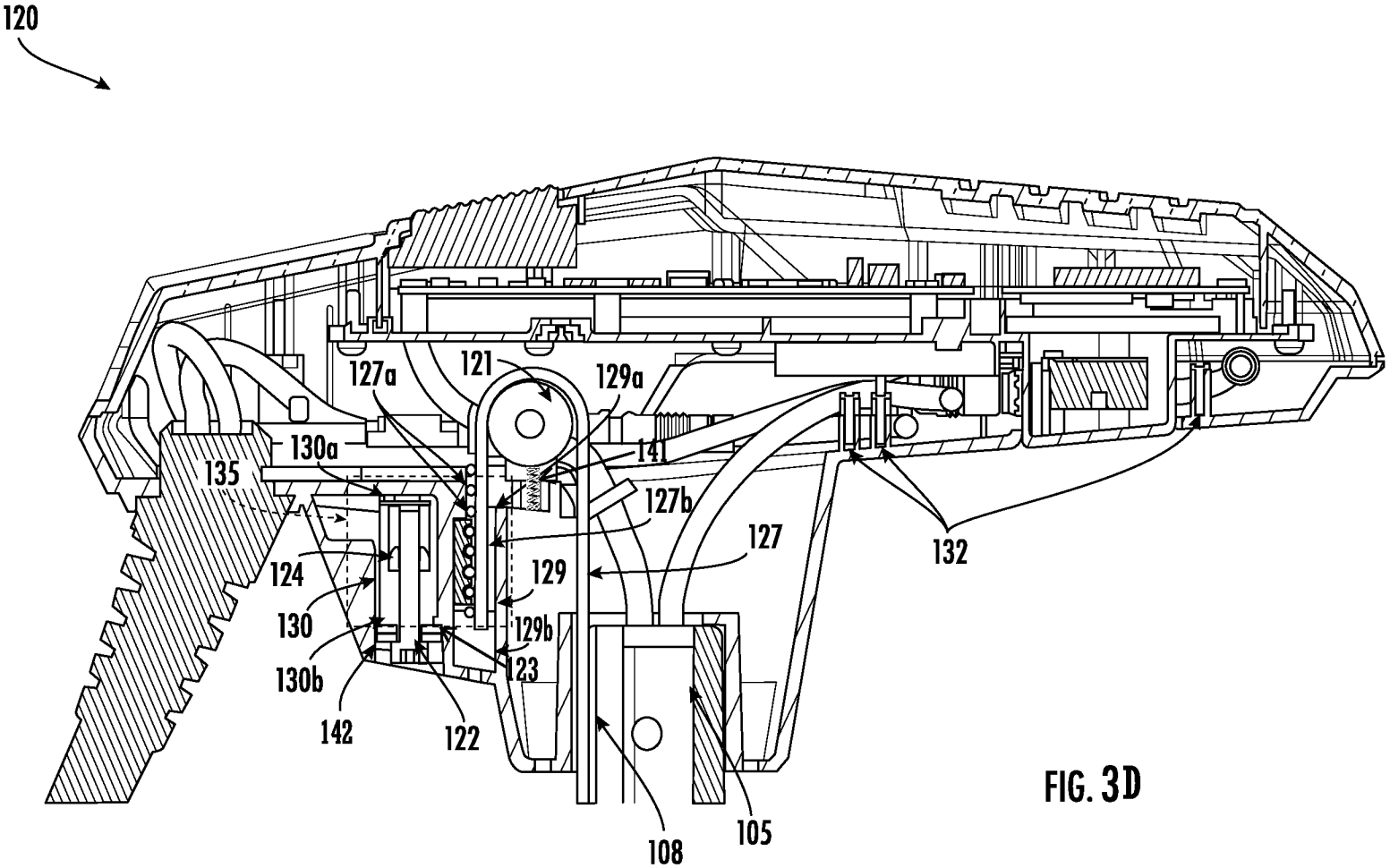
Figure 5A:
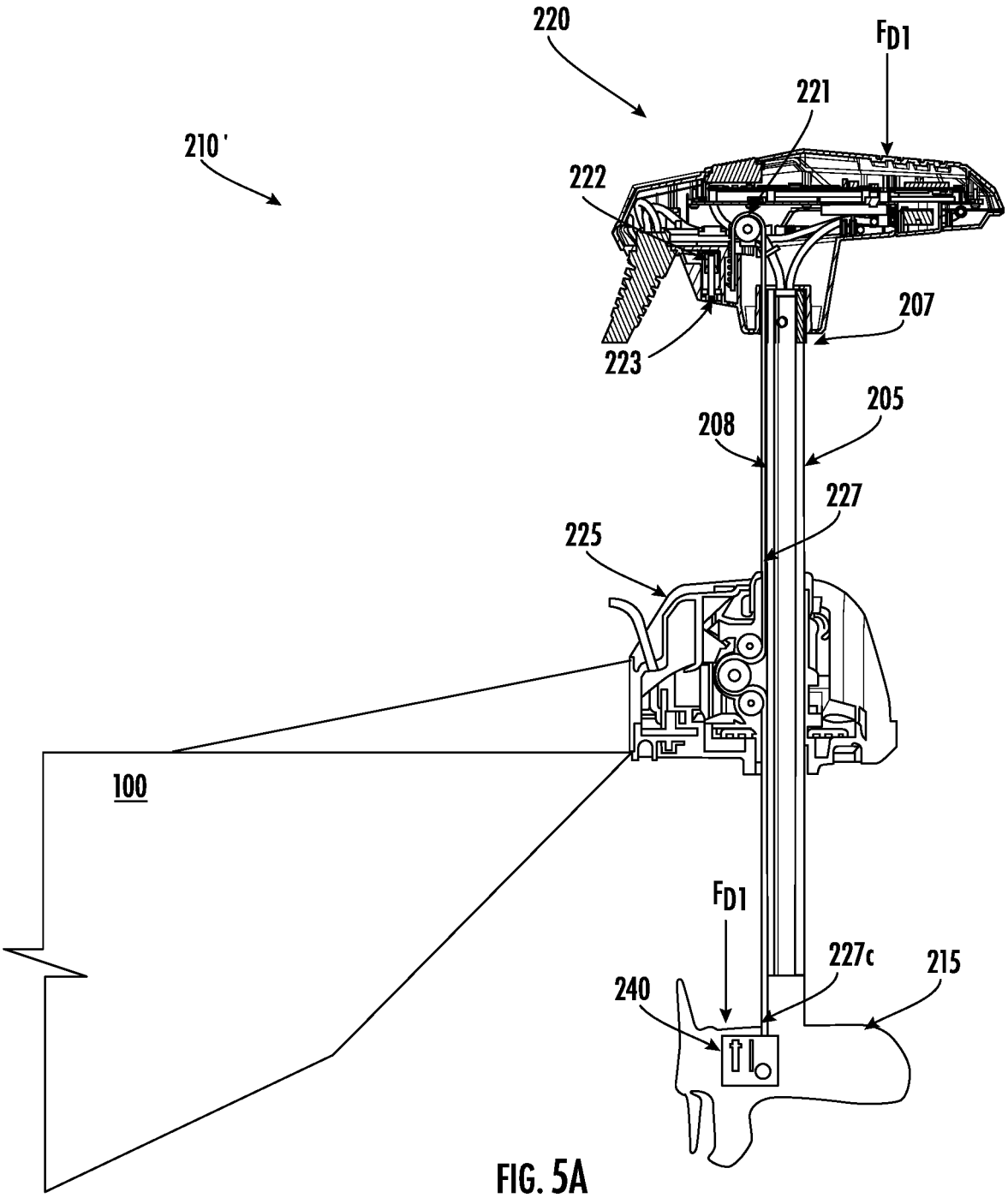
Figure 5B:
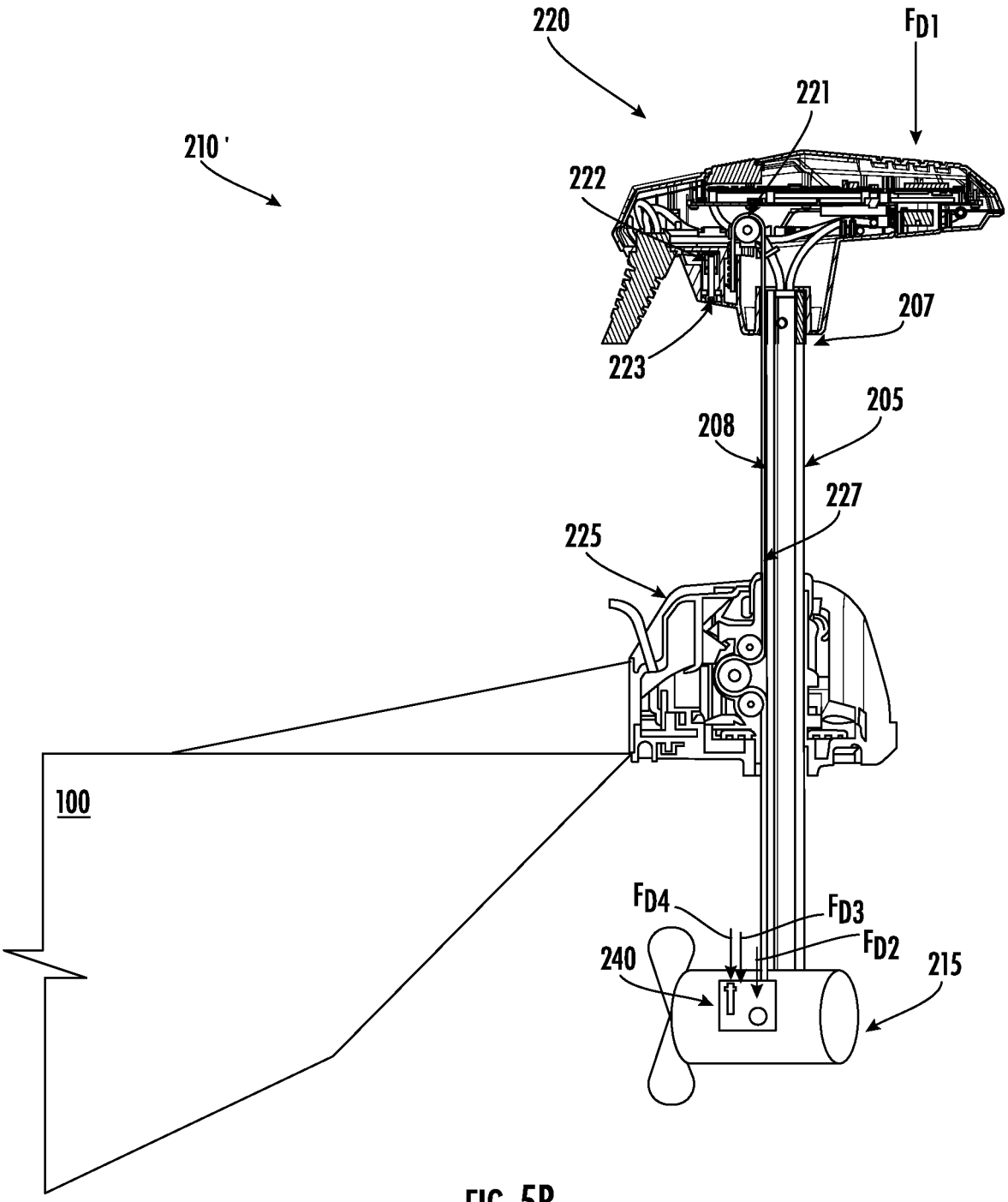
Figure 6:
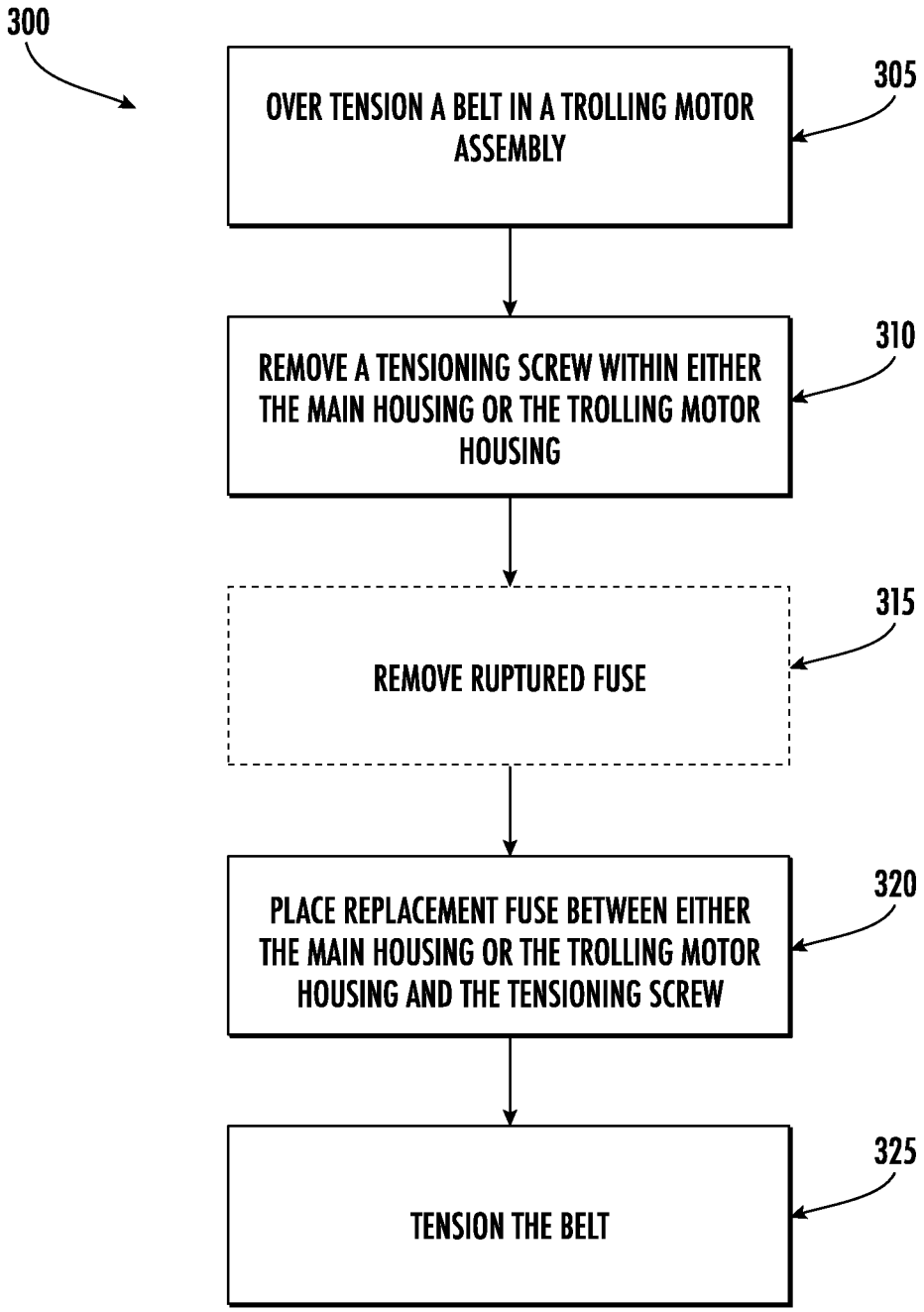

Having thus described the invention in general terms, reference will now be made to the accompanying drawings, which are not necessarily drawn to scale, and wherein:

FIG. 1 illustrates an example trolling motor assembly attached to a front of a watercraft, in accordance with some embodiments discussed herein;

FIG. 2 illustrates an example trolling motor assembly, in accordance with some embodiments discussed herein;

FIG. 3A illustrates a cross-sectional view of a main housing of the example trolling motor assembly shown in FIG. 2, in accordance with some embodiments discussed herein;

FIGS. 3B-C illustrate close-up cross-sectional views of an example tensioning system positioned in the main housing, in accordance with some embodiments discussed herein;

FIG. 3D illustrates a cross-sectional view of a main housing of the trolling motor assembly shown in FIG. 2, comprising an example tensioning system, in accordance with some embodiments discussed herein;

FIGS. 4A-D illustrate cross-sectional views of an effect of a force on the trolling motor assembly shown in FIG. 1, in accordance with some embodiments discussed herein;

FIGS. 5A-B illustrate cross-sectional views of an effect of a force on the trolling motor assembly shown in FIG. 1, in accordance with some embodiments discussed herein; and FIG. 6 illustrates a flowchart of an example method for replacing a fuse within the tensioning system, in accordance with some embodiments discussed herein.

DETAILED DESCRIPTION

Example embodiments of the present invention now will be described more fully hereinafter with reference to the accompanying drawings, in which some, but not all embodiments of the invention are shown. Indeed, the invention may be embodied in many different forms and should not be construed as limited to the example embodiments set forth herein; rather, these embodiments are provided so that this disclosure will satisfy applicable legal requirements. Like reference numerals refer to like elements throughout.

Various embodiments of the present invention provide trolling motor assemblies having a fuse configured to rupture upon an application of a predetermined amount of force to protect components of the trolling motor. For example, the fuse may rupture to relieve tension in a belt of the trolling motor assembly in order to prevent too much tension being applied to the belt, where the too much tension would likely cause a tear or other failure to occur in the belt. In this regard, for example, replacement of the fuse is considered less expensive and/or less disruptive than replacement of the belt.

FIG. 1 illustrates an example watercraft 10 on a body of water 101. The watercraft 10 has a trolling motor assembly 100, attached to its front by an attachment module 125, with a trolling motor housing 115 submerged in the body of water 101. In some embodiments, the attachment module 125 may include a trolling motor mount 113 (see e.g., FIG. 2) to mount the attachment module 125 to the watercraft 10. In some embodiments, the trolling motor within the trolling motor housing 115, which may be gas-powered or electric, for example, may be used as a propulsion system to provide thrust so as to cause the watercraft 10 to travel along the surface of the water. With further reference to FIG. 2, the trolling motor assembly 100 may also include a main housing 120 positioned out of the body of water 101 and at a top of a shaft 105. While the depicted embodiment shows the trolling motor assembly 100 attached to the front of the watercraft 10 and as a secondary propulsion system, and a primary propulsion system 106 attached to the rear of the watercraft 10, example embodiments described herein contemplate that the trolling motor assembly 100 may be attached in any position on the watercraft 10 and/or may serve as the primary propulsion system for the watercraft 10.

The trolling motor assembly 100 includes an attachment module 125 having a trim system for changing the position of the trolling motor housing 115 relative to the attachment module 125 (or watercraft) (e.g., by causing the trolling motor shaft 105 to move along the shaft axis $A_1$, shown in FIG. 2). Depending on the design, trimming may be accomplished, via foot control, or even through use of a remote control, thus a user may control the trimming without touching and/or seeing the position of the trolling motor assembly 100.

FIG. 2 illustrates an example trolling motor assembly 100. The trolling motor assembly 100 includes a shaft 105 having a first end 107 and a second end 109 defining a trolling motor shaft axis A1 extending therebetween. The trolling motor assembly 100 includes a main housing 120 attached to the first end 107 of the shaft 105, and a trolling motor housing 115 attached to the second end 109 of the shaft 105. In some embodiments, when the trolling motor assembly 100 is attached to the watercraft and the trolling motor housing 115 is submerged in the water, the trolling motor is configured to propel the watercraft to travel along the body of water. In addition to containing the trolling motor, the trolling motor housing 115 may include other components, for example, sonar transducer assemblies and/or other sensors/systems.

The main housing 120 is positioned outside of the body of water 101 and is connected to the shaft 105 proximate the first end 107 of the shaft 105. The main housing 120 may be configured to house components of the trolling motor assembly 100, such as may be used for processing marine and/or sensor data and/or controlling operation of the trolling motor among other things.

The trolling motor assembly 100 may further include an attachment module 125. In some embodiments, the attachment module 125 may be attached to the watercraft by a trolling motor mount 113, while in other embodiments, the attachment module 125 may be configured to attach directly to the watercraft. In some embodiments, the shaft 105 may extend through the attachment module 125, and the attachment module 125 may be configured to move the shaft 105 along the shaft axis $A_1$ via a belt 127 (e.g., vertically when the trolling motor is in the deployed state). In some embodiments, the belt 127 may extend between the trolling motor housing 115 and the main housing 120. In some embodiments, the shaft 105 may comprise a slot (e.g., 108 FIG. 3A) to receive the belt 127 extending there along.

In some embodiments, the watercraft attachment feature 113 secured to the attachment module 125 may allow for complete removal of the trolling motor assembly 100 from the watercraft (e.g., 10 FIG. 1) while in other embodiments, the watercraft attachment feature 113 may allow for hinging movement such that the trolling motor assembly 100 may rotate about an attachment point such that the trolling motor housing 115 is removed from the body of water (e.g., 101 FIG. 1)—e.g., the trolling motor may transition from a deployed state (within the water) and a stowed state (such as stored within the watercraft, such as on a deck of the watercraft).

FIG. 3A illustrates a cross-sectional view of the example main housing 120. In some embodiments, the main housing 120 may be secured in a closed position by at least one main housing screw 132. The at least one main housing screw 132 may be accessible from outside of the main housing 120 and may be configured to secure a top portion and a bottom portion of the main housing, while securing the contents of the main housing 120 and providing access to the internal component of the main housing 120.

In some embodiments, the belt 127 may extend into the main housing 120, wherein an end 127*b* of the belt 127 may be positioned within an anchor 135 to retain the end 127*b* of the belt 127. In some embodiments, the belt 127 may extend over a roller 121. The roller 121 may be configured to absorb vertical movement (e.g., parallel to the shaft axis $A_1$), to account for some tension within the belt 127 and/or main housing 120, for example due to the motion of the water about the trolling motor. In some embodiments, such as illustrated in FIG. 3D, a roller shock absorber 141 is provided. In this regard, the shock absorber 141 may be positioned between the roller 121 and the housing 120. The roller shock absorber 141 may add elasticity to the system as the belt 127 may display low stretch. In this regard, the roller shock absorber 141 may reduce the tension within the belt 127 by adjusting the position of the roller 121 by compression or decompression of the roller shock absorber 141. In some embodiments, the roller shock absorber 141 may be a spring, a robber grommet, a belville washer or similar.

Returning to FIG. 3A, in some embodiments, the belt 127 may comprise teeth 127*a* configured to interact with a tooth and notch gear to move the shaft 105 through the attachment module (e.g., 125 FIG. 2), such as during trimming of the shaft 105.

In some embodiments, the belt 127 may comprise semi-elastic properties. For example, the belt 127 may be configured to stretch along the shaft axis $A_1$. In some embodiments, the belt 127 may be made from an elastic material, for example, rubber, while in other embodiments, the belt may be a chain link, pulley system, or similar. In this regard, the belt may comprise some slack to account for variable movement due to expected forces within the body of water (e.g., waves).

As mentioned above, the belt 127 may be retained by the anchor 135 positioned within the main housing 120. In some embodiments, the anchor 135 may be a component in a tensioning system configured to adjust the tension in the belt 127. Having an adequate tension in the belt 127 allows the trolling motor assembly 100 to function properly. In this regard, when the tension in the belt 127 is too high, the belt 127 may be pulled off of the roller 121 and/or out of the anchor 135. In some cases, an over tensioned belt 127 may cause the belt 127 to rupture, overly stretch, or break in another manner. Similarly, an under tensioned belt 127 may cause extra wear on the trim system.

In order to protect the belt 127 and other components of the trolling motor assembly, the anchor 135 may be configured to move within the main housing. In this regard, the anchor 135, the belt 127 and the roller 121 may have some play (e.g., reciprocal movements to dampen the overall movement). In some embodiments, movement of the anchor 135 may correlate to tension within the belt 127. To explain, as illustrated in FIG. 3B, the anchor 135 defines an anchor space 137*a* above the anchor 135, while the anchor 135 illustrated in FIG. 3C the anchor defines the anchor space 137*b* below the anchor 135. Thus, since the belt 127 is positioned within the anchor 135 the positioning of anchor 135 creates or alleviates tension within the belt 127.

As described further herein, in some embodiments, the anchor 135 may comprise a first channel 129 defining a first end 129*a* and a second end 129*b*, and a second channel 130 defining a third end 130*a* and a fourth end 130*b*. In some embodiments, the first channel 129 may be configured to receive and retain the belt 127. In some embodiments, the second channel 130 may be configured to receive and retain a tensioning screw 122. In this regard, the anchor 135 may be a two part system: first, the anchor 135 may receive the belt 127 within the first channel 129; and second the anchor 135 may receive a tensioning screw 122 configured to vertically move the position of the anchor 135, thereby creating or alleviating tension within the belt.

FIGS. 3B-C illustrate cross-sectional views of a portion of a tensioning system 140 within the main housing 120 surrounding the anchor 130, illustrating the belt 127 in a tensioned state, shown in FIG. 3B, and illustrating the belt 127 in an un-tensioned state, shown in FIG. 3C.

In some embodiments, the anchor 135 may be configured to move within the main housing 120. As illustrated in FIG. 3B in the tensioned state the anchor 135 defines the anchor space 137*a* above the anchor 135 (e.g., on the side of the first opening 129*a* and the third opening 130*a*). Said differently, in the tensioned state the anchor 135 abuts the main housing 120 at a tensioning screw hole 128.

In some embodiments, the first channel 129 is configured to retain the belt 127 of the trolling motor. As discussed above, the belt 127 may comprise teeth 127*a* positioned on the belt 127. The teeth 127*a* may be used to transition the shaft along the shaft axis (e.g., $A_1$ FIG. 2). In some embodiments, the first channel 129 may comprise a retaining ratchet 126. The retaining ratchet may be configured to interlock with the teeth 127*a* of the belt 127 to secure the end 127*b* of the belt 127 within the anchor 135. In some embodiments, rather than a tooth and ratchet, the belt 127 may be configured as a chain, as a ribbed belt, a flat belt, a cogged belt, a banded belt, a linked belt, or other belt, which may be configured to move the shaft through the attachment module.

In some embodiments, the ratchet retainer may be configured to interlock with the teeth of the belt 127. Interlocking the teeth 127*a* of the belt 127 within the ratchet retainer 126 retains the belt within the main housing 120. The present invention uses a stationary ratchet retainer 126 within the anchor 135 to secure the belt 127 within the anchor 135 and utilizes the tensioning screw 122 to move the anchor 135 and, thus, tension the belt 127.

As discussed, over tensioning or under tensioning may lead to issues, for example, the belt 127 may break, the ratchet retainer 126 may slip, the belt 127 may come off of the roller 121 etc. Notably, fixing the belt, reattaching a belt that disengages, or installing a new belt can be difficult, particularly while on the water. Thus, to solve the issue, some embodiments of the present invention provide a fuse 123 that can absorb the force and break to relieve the tension. In the illustrated example, such as shown in FIG. 3B, the fuse 123 is positioned between the tensioning screw 122 and the main housing 120, such that with an application of a predetermined amount of force, the fuse 123 may rupture (e.g., break, crack, fail, etc.) causing the anchor 135 to shift into the upper anchor space 137*a* (thereby creating the lower anchor space 137*b*) to un-tension the belt, thereby preventing the above issues. In some embodiments, the positioning of the fuse 123 may be external to the main housing 120. Notably, in either case, if the fuse 123 fails, a user may easily position a replacement fuse 123 about the tensioning screw 122, replace the tensioning screw 122 in the main housing 120, and retention the belt 127 accordingly.

In some embodiments, the second channel 130 may comprise an anchor ledge 136. To explain, the second channel 130 may comprise varying diameters between the third end 130*a* and the fourth end 130*b*. In some embodiments, the second channel 130 may define a first anchor diameter $D_{A1}$ extending between the third end 120*a* and the anchor ledge 136. In some embodiments, the second channel 130 may define a second anchor diameter $D_{A2}$ extending between the fourth end 130*b* and the anchor ledge 136. In this regard, the anchor ledge 136 may constrict the diameter of the second channel 130 from the third end 130*a* to the fourth end 130*b*. Thus, the second anchor diameter $D_{A2}$ may be smaller than the first anchor diameter $D_{A1}$. As will be explained further herein, a fastener 124 may be positioned on the anchor ledge 136 to be retained within the second channel 130.

In some embodiments, the tensioning screw 122 may comprise a head 122*a* and a body 122*b* extending therefrom. In some embodiments, the head 122*a* may define a screw head diameter $D_{S2}$, and the body 122 may define a screw body diameter $D_{S1}$. In some embodiments, the screw body diameter $D_{S1}$ may be smaller than the screw head diameter $D_{S2}$. In some embodiments, the second anchor diameter $D_{A2}$ may be sized to receive the body 122*b* of the tensioning screw 122. In this regard, the screw body diameter $D_{S1}$ may be slightly smaller than the second anchor diameter $D_{A2}$. In some embodiments, the portion of the anchor 135 defining the second anchor diameter $D_{A2}$ may be threaded, so as to interact with the threads from the body 122*b* of the tensioning screw 122. In this regard tightening or loosening the tensioning screw 122 allows the position of the anchor 135 to move within the main housing 120.

In some embodiments, the fastener 124 may be positioned within the second channel 130 and the fastener 124 may rest on the anchor ledge 136. In some embodiments, the fastener 124 may be a nut, a washer, or similar fastener means configured to receive and retain the body 122*b* of the tensioning screw 122. In some embodiments, the fastener 124 defines a fastener diameter $D_N$ which may be equivalent to or smaller than the first anchor diameter $D_{A1}$. Thus, the fastener 124 may be retained within the second channel 130 by the anchor ledge 126. In some embodiments, the fastener 124 may comprise threading configured to mate with threading on the body 122*b* of the tensioning screw 122. Thus, the tensioning screw 122 may secure the position of the anchor 135 within the main housing 120, thereby causing the tension of the belt 127 based on the position of the anchor 135 within the main housing 120.

The tensioning screw hole 128 within the main housing 120 allows tensioning of the belt 127 from an external access point. In some embodiments, the tensioning screw hole 128 may define a first housing diameter $D_{H1}$ and a second housing diameter $D_{H2}$. In some embodiments, the first housing diameter $D_{H1}$ may be positioned at the point of entry (e.g., the position where the tensioning screw 122 may cross the plane of the main housing 122). In this regard, the first housing diameter $D_{H1}$ may be larger than the screw body diameter $D_{S1}$ and smaller than the screw head diameter $D_{S2}$.

In some embodiments, illustrated in FIG. 3C, the tensioning screw hole 128 may be configured with a fuse shelf 128*a*, similar to the anchor shelf 136. To explain, the fuse shelf 128*a* may be configured as the interface between the first housing diameter $D_{H1}$ and the second housing diameter $D_{H2}$. In some embodiments, the second housing diameter $D_{H2}$ may be larger than the first housing diameter $D_{H1}$, thus, the size of the shelf 128*a* may be the difference between the first housing diameter $D_{H1}$ and the second housing diameter $D_{H2}$.

In some embodiments, the second housing diameter $D_{H2}$ may be positioned closer to the exterior of the main housing 120, in comparison to the first housing diameter $D_{H1}$. In some embodiments, the second housing diameter $D_{H2}$ may be larger than the screw head diameter $D_{S2}$. Thus, the tensioning screw 122 may be able to easily pass through the tensioning screw hole 128 defining the second housing diameter $D_{H2}$.

In some embodiments, with reference to FIG. 3B, a fuse 123 may be positioned between the tensioning screw head 122*a* and the fuse shelf 128*a*. In some embodiments, the fuse 123 may be configured as a disc, defining an outer fuse diameter $D_F$ and an inner fuse diameter $D_{FI}$. In some embodiments, the outer fuse diameter $D_F$ may be larger than the first housing diameter $D_{H1}$, and the outer fuse diameter $D_F$ may be smaller than the second housing diameter $D_{H2}$. Thus, the fuse 123 may be configured to be positioned to abut the fuse shelf 128*a* of the tensioning screw hole 128.

In some embodiments, the inner fuse diameter $D_{FI}$ may be configured to receive the tensioning screw body 121*b*. In this regard, the inner fuse diameter $D_{FI}$ may be larger than the screw body diameter $D_{S1}$.

In some embodiments, the anchor 135 is held by the tensioning screw 122 between the fastener 124 and the fuse 123. Thus, as illustrated in FIG. 3B, in order to dissipate tension in the belt 127 the tensioning screw 122 would be loosened such that a smaller portion of the screw body 122*b* is within the second channel 130 of the anchor 135. In this regard, the anchor 135 may shift into the upper anchor space 137*a* creating the lower anchor space 137*b*, illustrated in FIG. 3C.

Similarly, in this regard, in an over tensioning event (due to over tightening of the tensioning screw 122 and/or an application of extra force for example), the fuse 123 may rupture, as illustrated in FIG. 3C. Upon rupturing of the fuse 123, the tensioning screw 122 may shift further into the tensioning screw hole 128 such that the tensioning screw head 122*a* may be positioned past the fuse shelf 128*a* (e.g., the portion of the tensioning screw hole defining the first housing diameter $D_{H1}$). The rupture of the fuse 123 may allow the anchor 135 to shift into the upper anchor space 137*a*, creating the lower anchor space 137*b* between the anchor 135 and the main housing 120.

Thus, when the belt 127 is over tensioned or a force is applied to the trolling motor which may apply a force to the belt 127, rather than breaking the belt 127, breaking the ratchet retainer 126, shifting off of the roller 121 or other issue, the fuse 123 may rupture, and allow the anchor 135 to move in order to reduce the tension on the belt 127 and system. In this regard, if the fuse 123 breaks, the user may access and remove the tensioning screw 122, from the main housing 120, position a new fuse about the tensioning screw body, reposition the tensioning screw 122 within the anchor 135, and retention the belt to the desired tension.

In some embodiments, the fuse 123 may be made from plastic. In some embodiments, the fuse 123 may be made from a brittle material and may be configured to rupture and/or crack under a predetermined amount of force, while maintain structured under forces less than the predetermined amount of force. In some embodiments, the fuse 123 may be configured as a spring.

In some embodiments, such as illustrated in FIG. 3D, the system may include an anchor shock absorber 142 positioned between the tensioning screw 122 and the fuse 123. The anchor shock absorber 142 may provide elasticity to the system thereby reducing the amount of replacement fuses that may be needed. In some embodiments, the anchor shock absorber 142 may be a spring, a rubber grommet, a belville washer, or similar. In some embodiments, the roller shock absorber 141 may be the same type of shock absorber as the anchor shock absorber 142, while in other embodiments two different types of shock absorbers may be used. In some embodiments, the system may use only one of the roller shock absorber 141 or the anchor shock absorber 142, while in other embodiments both of the roller shock absorber 141 and the anchor shock absorber may be used.

As described above, this allows a user a quick fix when on the body of water, or when the user returns to shore. Although explained in relation to the main housing 120, in some embodiments, a similar anchor, tensioning screw and fuse system may be positioned in the trolling motor housing 115, such as where the belt 127 is secured within the trolling motor housing.

FIGS. 4A-D illustrate a trolling motor assembly 210 exposed to an upward force $F_1$. Depending on the circumstance, the upward force $F_1$ may, for example, be generated by lowering the trolling motor on to a bottom surface of the body of water, the trolling motor assembly 210 hitting an object submerged within the body of water, or due to turbulence from disturbances in the body of water (e.g., waves).

As discussed, the trolling motor assembly 210 may be attached at the bow of the watercraft 100 by an attachment module 225. Thus, the shaft 205, the trolling motor housing 215 and the main housing 220 are movable with respect to the attachment module 225. Thus, any force, for example the upwards force $F_1$, illustrated in FIG. 4A, on the trolling motor housing 215 creates a series of forces throughout the trolling motor assembly 210.

Figure 4A:
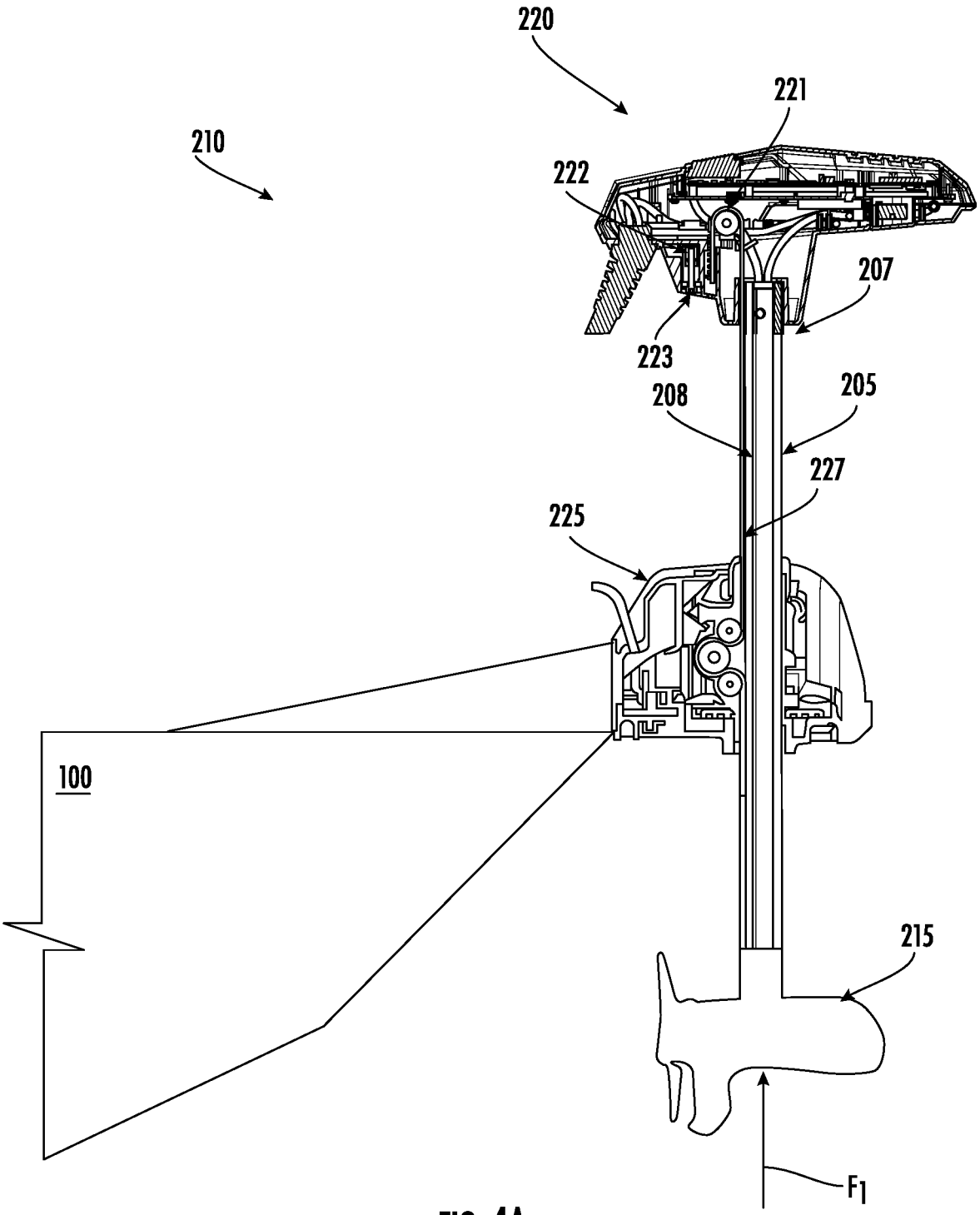
Figure 4B:
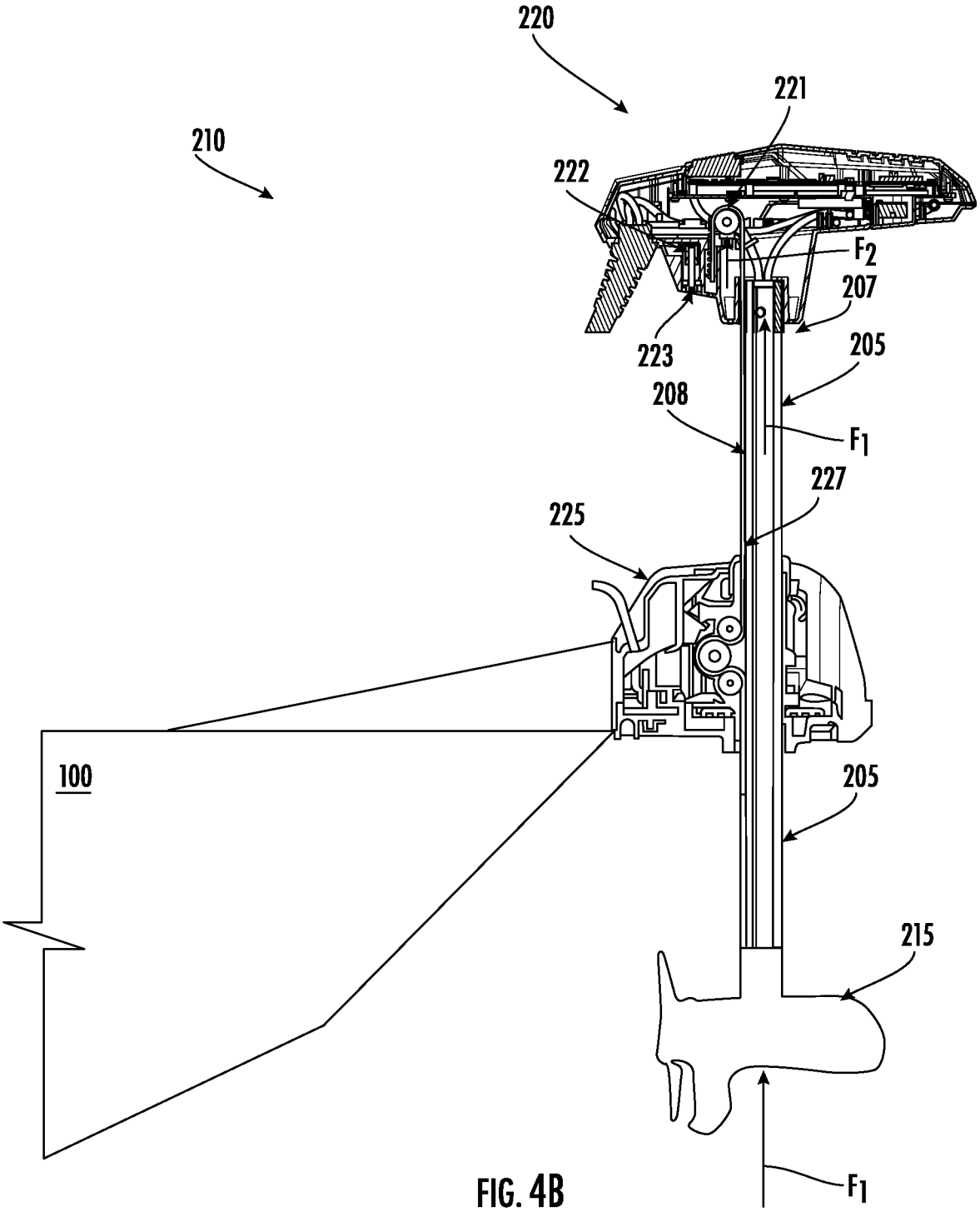

Thus, as illustrated in FIG. 4B, the upward force $F_1$ translates through the shaft 205 and causes a second force $F_2$ to act on the main housing 220. The second force $F_2$ is likewise an upward force and the upward force $F_1$ travels through the shaft 205 and causes the main housing 220 to shift upward due to the main housing 220 being directly connected to the shaft 205.

In contrast the belt 227 may remain stationary in relation to the shaft 205 as the belt 227 is fixed in both the main housing 220 and the trolling motor housing 215, and within the attachment module 225. As mentioned earlier, the attachment module 225 remains stationary, as it is fixed on the watercraft 100. Thus, although the shaft 205 may shift within the attachment module 225 the attachment module 225, does not react to the upward force $F_1$ in the same manner as the shaft 205 and the main housing 220, e.g., with an upward force.

Figure 4C:
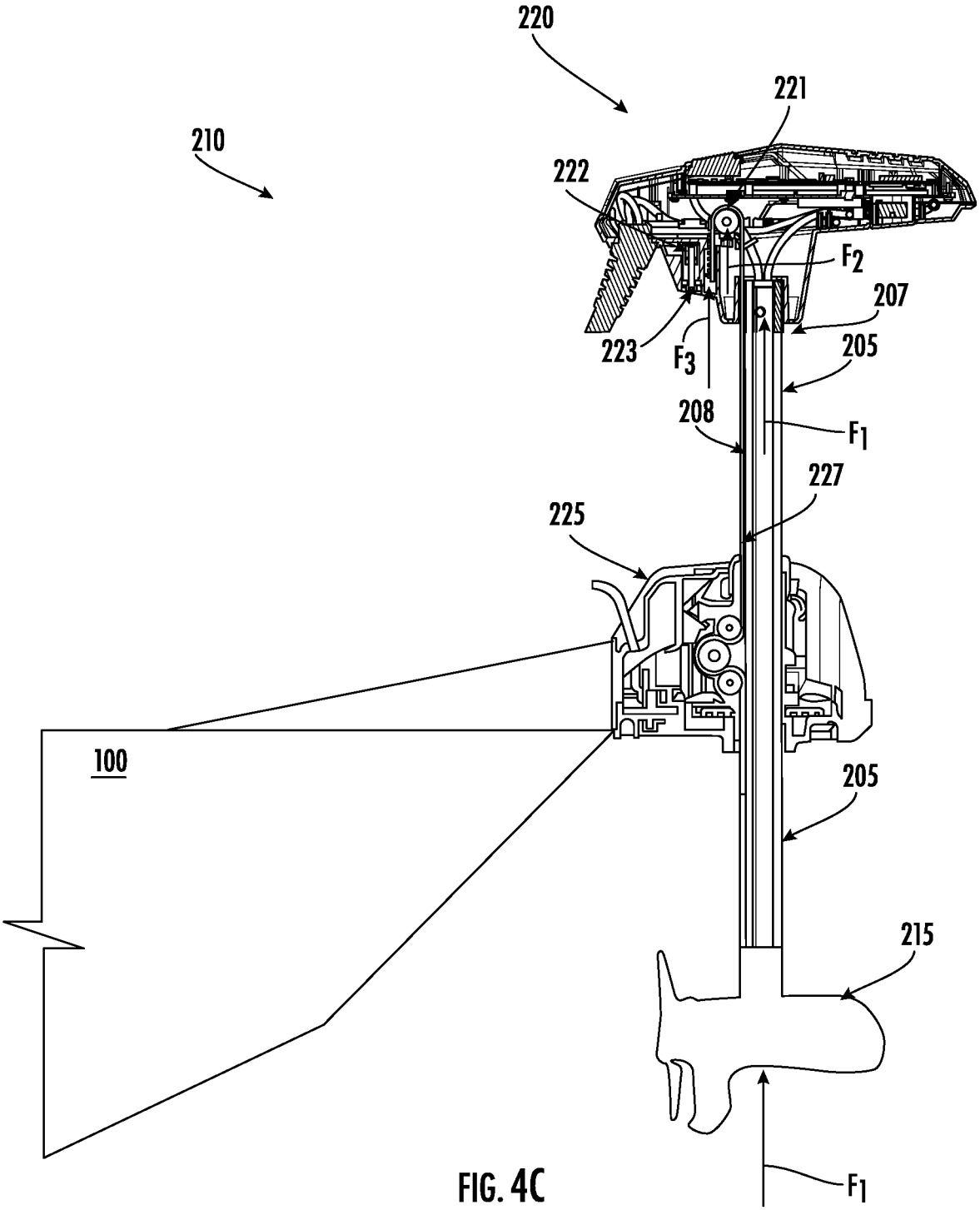

The upward force $F_1$ and the second force $F_2$ cause the belt 227 to be shifted upward, thereby creating a third force $F_3$, illustrated in FIG. 4C. The third force $F_3$ results from the belt 227 being engaged in the anchor 235 by the teeth 227*a* and the ratcheting retainer 226. As the belt 227 is stationary with respect to the shaft 205, when the shaft 205 and the main housing 220 are shifted upward due to the upward force $F_1$ the belt 227 responds to the forces. Thus, to dissipate the added tension within the belt 227, the end 227*b* of the belt 227 positioned within the anchor 235 is pulled upward (e.g., in accordance with the upward force $F_1$ and the second force $F_2$) thereby generating a third force $F_3$ within the first channel (e.g., 129 of FIG. 2). The third force $F_3$ may cause the anchor 235 to move into the anchor space above the anchor 235.

In this regard, if the belt 227 does not have any relief mechanism, the belt 227 may rupture, the ratcheting retainer 229 may be stripped, the belt may unsecure from within the ratcheting retainer or other issues within the main housing.

Figure 4D:
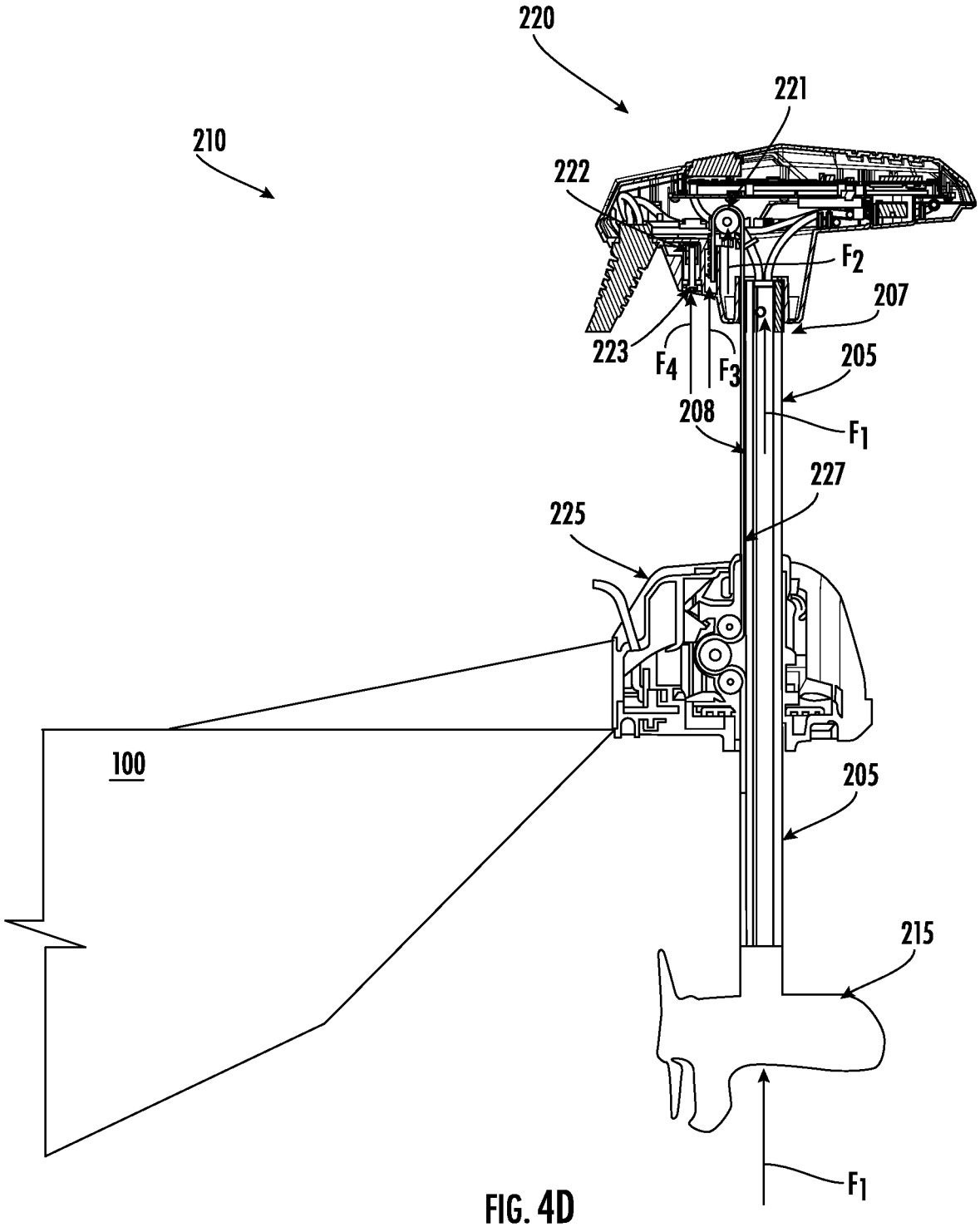

To avoid these issues, the fuse 223 may be configured to rupture and relieve the forces. To explain, as illustrated in FIG. 4D and discussed above, the belt 227 exerts a third force $F_3$ on the anchor 235, causing the anchor 235 to move into the anchor space to relieve the tension in the belt 227 due to the upward force $F_1$. As a result, since the first channel 229 and the second channel 230 are both within the same anchor 235, the first channel 230 and the tensioning screw 222 therein have a fourth force $F_4$ acting in an upward direction. Here, as discussed, the fuse 223 is configured to rupture to allow the tensioning screw 222 to shift further into the tensioning screw hole, and allowing the anchor 235 to move from the tensioned state (e.g. FIG. 3B) to the untensioned state (FIG. 3C).

Thus, with sufficient force, specifically the third force $F_3$ created between the belt 227 and the ratcheting retainer 226, the fuse 223 may be configured to rupture, to allow the anchor 235 to shift within the main housing 220 and relieve the tension in the belt due to the upward force $F_1$.

In some embodiments, with reference to FIGS. 5A-B, a trolling motor housing 215 may comprise a tensioning system 240, configured to tension the belt 227 within the trolling motor housing 215. In this regard, the tensioning system 240, may comprise similar components as the tensioning system 140 described with reference to FIGS. 3B-C.

For example, the tensioning system 240 may comprise the anchor 135, the first channel 129, the second channel 130, the tensioning screw 122, and the fuse 123, illustrated in FIGS. 3B-C. Thus, the tensioning system 240 positioned within the trolling motor housing 215 may retain a second end 227*c* of the belt 227, to maintain the tension within the belt 227 such that the trolling motor housing 215 may trim along the shaft axis $A_1$.

FIGS. 5A-B illustrate an example a trolling motor assembly 210' exposed to a downward force $F_{D1}$. In some embodiments, the downward force $F_{D1}$ may be caused by a user or object falling on the main housing, or the trolling motor being caught on an object (e.g., log) while the motor is trimming upwards (e.g., out of the water). As such, the downward force $F_{D1}$ may translate through the main housing 220, the shaft 205, and the trolling motor housing 215 into the tensioning system 240. Thus, as explained with reference to FIGS. 4A-D, in the event of an upward force, the downward force $F_{D1}$ exerted on the trolling motor assembly 210' creates other acting forces within the trolling motor housing 215, which may cause the belt 227 to rupture, slip, or similar.

To explain, the downward force $F_{D1}$ on the main housing causes a second downward force $F_{D2}$ to be emitted on the trolling motor housing 215, due to the direct connection to the main housing. As the tensioning system 240 is retained within the trolling motor housing a third downward force $F_{D3}$ is created within the first channel at the ratcheting retainer, and a corresponding fourth downward force $F_{D4}$ is created within the second channel.

As the tensioning system 240 is configured to move within the trolling motor housing 215 (e.g., to tension the belt) while being secured to the trolling motor housing 215, the fuse 223 is configured to rupture thereby alleviating the third downward force $F_{D3}$ and the fourth downward force $F_{D4}$. Allowing the fuse to rupture as a known failure point allows the tensioning system 240 to be retained by the trolling motor housing 215 without being fixed within the trolling motor housing 215, thereby alleviating the tension within the belt 227.

Example Flowchart(s)

FIG. 6 is a flowchart illustrating an example method 300 for replacing a fuse within a trolling motor assembly. At operation 305 the belt of the trolling motor assembly is over tensioned causing a fuse to fail. In some embodiments, the belt may be over tensioned due to an external force, while in some embodiments a user may over tighten a tensioning screw. In some embodiments, as the belt is over tensioned the fuse positioned between the tensioning screw and either the main housing or the trolling motor housing may fail (e.g., break).

At operation 310 the tensioning screw may be removed from the housing where the fuse failed. Thus, if the fuse adjacent the main housing failed, the tensioning screw within the main housing is removed, or if the fuse adjacent the trolling motor housing failed, the tensioning screw within the trolling motor housing is removed.

Optionally, at operation 315 the ruptured fuse may be removed. In some embodiments, the ruptured fuse will fall out when the tensioning screw is removed, or the ruptured fuse may fall out of the housing upon failure.

At operation 320, a replacement fuse may positioned on the tensioning screw, and the tensioning screw may be positioned into the housing. In some embodiments, the replacement fuse may be positioned within either the main housing or the trolling motor housing, thereby providing the user easy access to a replacement fuse and storage for a replacement fuse. At operation 325, the belt may be tensioned to the desired tension with the tensioning screw.

Conclusion

Many modifications and other embodiments of the invention set forth herein will come to mind to one skilled in the art to which these inventions pertain having the benefit of the teachings presented in the foregoing descriptions and associated drawings. Therefore, it is to be understood that the embodiments of the invention are not to be limited to the specific embodiments disclosed and that modifications and other embodiments are intended to be included within the score of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposed of limitation.

What is claimed is:

1. A trolling motor assembly configured for attachment to a watercraft, the trolling motor assembly comprising:

a shaft having a first end and a second end defining a shaft axis extending therebetween;

a trolling motor at least partially contained within a trolling motor housing, wherein the trolling motor housing is attached to the second end of the shaft;

a main housing connected to the shaft proximate the first end of the shaft;

a belt extending between the trolling motor housing and the main housing; and a fuse positioned in at least one of the main housing or the trolling motor housing, configured to reduce stress from the shaft applying a force to the belt in the at least one of the main housing or the trolling motor housing.

2. The trolling motor assembly of claim 1, wherein the fuse is designed to fail under the application of a predetermined amount of the force.

3. The trolling motor assembly of claim 2, wherein the predetermined amount of the force is between 10-20 Newtons.

4. The trolling motor assembly of claim 3, wherein the force is applied along the shaft axis.

5. The trolling motor assembly of claim 1 further comprising an attachment module disposed about the shaft, wherein the attachment module is configured to engage the belt to trim the shaft along the shaft axis.

6. The trolling motor assembly of claim 1, wherein the fuse is made from a brittle plastic.

7. The trolling motor assembly of claim 1, wherein the fuse is configured as a rupture disc.

8. The trolling motor assembly of claim 1, further comprising a replacement fuse within one of either the main housing or the trolling motor housing.

9. The trolling motor assembly of claim 1, wherein the belt comprises semi-elastic properties.

10. The trolling motor assembly of claim 1, wherein the fuse is a spring configured to compress to alleviate tension within the belt.

11. The trolling motor assembly of claim 1, wherein the fuse is positioned in the main housing.

12. The trolling motor assembly of claim 1, wherein the fuse is positioned in the trolling motor housing.

13. The trolling motor assembly of claim 1 further comprising:

an anchor positioned within the at least one of the main housing or the trolling motor housing, wherein the anchor defines a first channel extending between a first opening and a second opening, and a second channel extending between a third opening and a fourth opening, wherein the first channel is configured to receive and retain the belt; and a fastener movable within the second channel, wherein the fastener is configured to receive a tensioning screw, wherein the tensioning screw comprises a head and a body;

wherein the fuse is positioned about the tensioning screw between the head and the anchor, wherein the fuse is designed to fail under a predetermined amount of the force that is applied to the fuse through the belt.

14. The trolling motor assembly of claim 13, further comprising an anchor shock absorber positioned between the fuse and the head of the tensioning screw.

15. The trolling motor assembly of claim 1, further comprising:

a roller disposed in either the main housing or the trolling motor housing, wherein the belt is positioned over the roller; and a roller shock absorber, wherein the roller shock absorber is configured to reduce stress from the shaft applying a force to the belt in the at least one of the main housing or the trolling motor housing.

16. A tensioning system for use within a main housing or a trolling motor housing of a trolling motor assembly, the tensioning system comprising:

an anchor defining a first channel extending between a first opening and a second opening, and a second channel extending between a third opening and a fourth opening, wherein the first channel is configured to receive and retain a belt of the trolling motor assembly;

a fastener movable within the second channel, wherein the fastener is configured to receive a tensioning screw, wherein the tensioning screw comprises a head and a body;

a fuse positioned about the tensioning screw between the head and the anchor, wherein the fuse is designed to fail under a predetermined amount of force applied to the fuse through the belt.

17. The tensioning system of claim 16, wherein the fuse defines an outer fuse diameter and an inner fuse diameter, and wherein the tensioning screw defines a body diameter and a head diameter, wherein the head diameter is greater than the body diameter, and wherein the inner fuse diameter is greater than the body diameter, and smaller than the head diameter.

18. The tensioning system of claim 16, wherein the anchor is configured to move linearly with respect to the first channel and the second channel, and wherein the movement of the anchor adjusts tension in the belt.

19. A trolling motor assembly configured for attachment to a watercraft, the trolling motor assembly comprising:

a shaft having a first end and a second end defining a shaft axis extending therebetween;

a trolling motor at least partially contained within a trolling motor housing, wherein the trolling motor housing is attached to the second end of the shaft;

a main housing connected to the shaft proximate the first end of the shaft;

a belt extending between the trolling motor housing and the main housing; and a tensioning system disposed within at least one of the main housing or the trolling motor housing, the tensioning system comprising:

an anchor defining a first channel extending between a first opening and a second opening, and a second channel extending between a third opening and a fourth opening, wherein the first channel is configured to receive and retain the belt;

a fastener movable within the second channel, wherein the fastener is configured to receive a tensioning screw, wherein the tensioning screw comprises a head and a body; and a fuse positioned about the tensioning screw between the head and the anchor, wherein the fuse is designed to fail under a predetermined amount of force applied to the fuse through the belt.

20. The trolling motor assembly of claim 19, wherein the tensioning system is positioned in the main housing.

* * * * *